United States Patent [19]

Turner et al.

[11] Patent Number: 4,907,808

[45] Date of Patent: Mar. 13, 1990

[54] TRIVIA BOARD GAME

[76] Inventors: Glenn Turner; Danny Walters, both of 415 Charlotte Ave., Rocky Mount, N.C. 27804

[21] Appl. No.: 270,946

[22] Filed: Nov. 14, 1988

[51] Int. Cl.[4] ..... A63F 3/00

[52] U.S. Cl. ..... 273/240; 273/250; 273/276; 273/290

[58] Field of Search ..... 273/249, 276, 288, 290, 273/250, 240

[56] References Cited

U.S. PATENT DOCUMENTS

| | | | |
|---|---|---|---|
| 4,029,320 | 6/1977 | Hausman | 273/249 |
| 4,201,388 | 5/1980 | Coutelon | 273/251 |
| 4,323,249 | 4/1982 | Brady | 273/249 |
| 4,640,513 | 2/1987 | Monutijo | 273/249 |

FOREIGN PATENT DOCUMENTS

| | | | |
|---|---|---|---|
| 2187393 | 9/1987 | United Kingdom | 273/249 |

OTHER PUBLICATIONS

Trivial Pursuit, Master Game–Rules of play, Selchow & Righter Co., 1981.

*Primary Examiner*—William H. Grieb
*Assistant Examiner*—Benjamin Layno
*Attorney, Agent, or Firm*—Terry M. Gernstein

[57] ABSTRACT

A board game is based on trivia associated with STAR TREK. The game provides a plurality of knockdown models representing the Enterprise. Each model has a game piece which doubles as a base of the model. Players start by moving their game pieces along a selected playing path towards a selected destination area according to the roll of dice. Upon landing on a destination space, a player must pick a trivia card and answer a question corresponding to the destination space landed on. If the answer is correct, the player is awarded a model portion and checks off the appropriate category represented on the destination area on a category card checklist. Players continue collecting the model portions and assembling them on their game piece while moving from destination to destination. The first person to obtain all model portions of the ENTERPRISE and returns to earth wins the game. Various penalties and detours are included in the game.

1 Claim, 3 Drawing Sheets

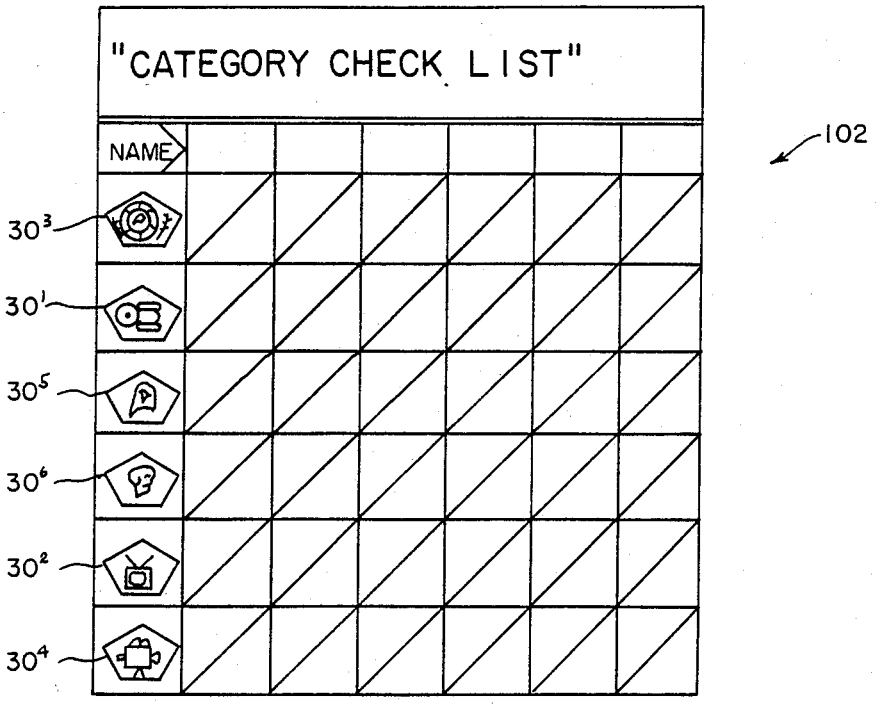
FIG. 6
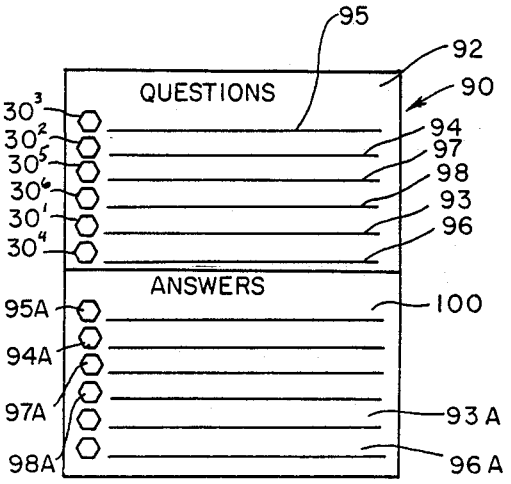
FIG. 5
FIG. 8
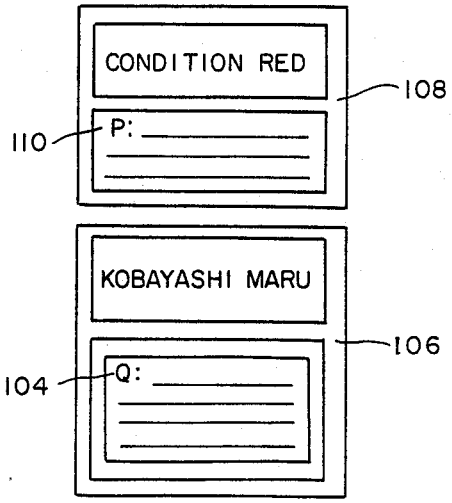
FIG. 7

TRIVIA BOARD GAME

TECHNICAL FIELD OF THE INVENTION

The present invention relates to the general field of board games, and to the particular area of question and answer games. Specifically, the present invention relates to a board game based on trivia associated with STAR TREK.

BACKGROUND OF THE INVENTION

Question and answer games, such as disclosed in U.S. Pat. No. 4,736,954, are quite popular, and there are many variations of such games available. Still further, games based on trivia have obtained increased popularity in recent times. Examples of such trivia based games are often found on quiz shows, and the like, Still further, the adventures of the starship ENTERPRISE and its crew has found phenomenal popularity, even spawning a group of people, known as TREKKIES, that are close followers of the adventures of STAR TREK.

It is therefore an object of the present invention to combine the above-mentioned board games with the above-mentioned trivia games and to combine these games in such a manner as to take advantage of all of the potential situations associated with STAR TREK.

It is noted that the present invention is in no way sponsored by or associated with the author, the manufacturer of other STAR TREK devices or with the distributor of the STAR TREK adventures.

SUMMARY OF THE INVENTION

The present invention includes a game board that is divided according to various aspects of the total STAR TREK history and the elements of the various STAR TREK adventures. The object of the game is to assemble a model of the ENTERPRISE and then advance to a specified area of the game board. Various parts of such starship are awarded for achieving certain areas of the game board.

The game includes barriers to such achievements and advancement toward such achievements is made by rolling dice and answering questions based on STAR TREK trivia.

The first player to assemble an entire ENTERPRISE and to advance to the specified playing area wins the game.

DESCRIPTION OF THE FIGURES

FIG. 5 is a plan view of a question card used in the game, it being noted that FIG. 5 shows both the front and the rear of the card for the sake of convenience.

FIG. 6 is a plan view of a game card used in the game.

FIG. 7 is a plan view of a special question card used in the game, it being noted that the front of the card is shown and includes a question that must be answered, with the answer to such question appearing either in the book shown in FIG. 2 or on the back of the card.

FIG. 8 is a plan view of a special instruction card used in the game with the front of the card being shown as having a penalty for not correctly answering a question that appears on the FIG. 7 game card.

FIG. 9 is a perspective showing a dice used in the game of the present invention.

DETAILED DESCRIPTION OF THE PREFERRED EMBODIMENT

Figure 1:
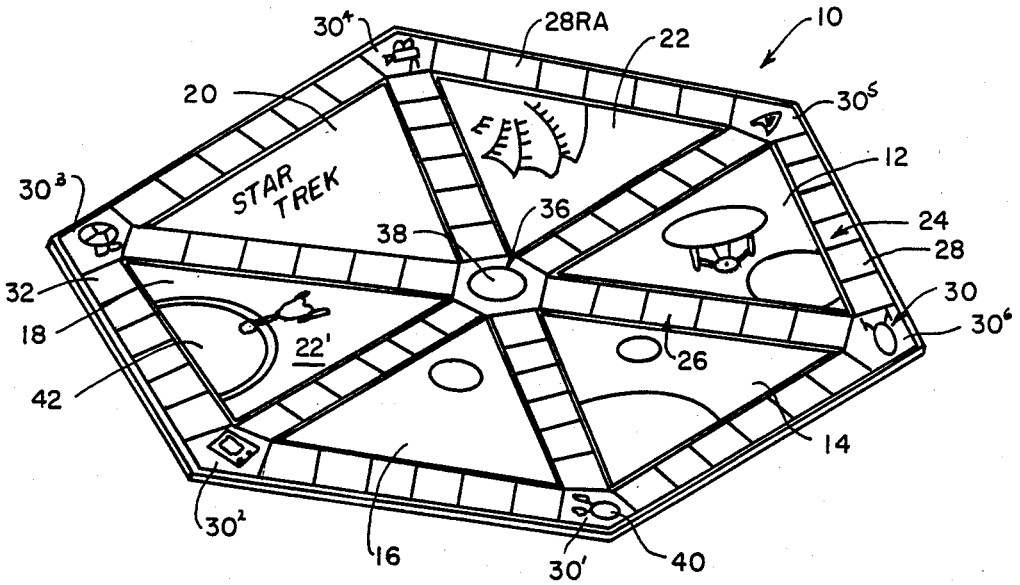
FIG. 1 is a perspective of a game board used in the game embodying the present invention.

Shown in FIG. 1 is the basic game board 10 used for the game embodying the present invention. The game board 10 is hexagonal in peripheral shape and is divided into size areas 12–22, which are bordered by game piece movement areas such as areas 24 and 26 bordering area 12. The game piece movement areas are divided into a plurality of game piece landing areas, such as area 28 and destination area 30. As will be discussed below, the game piece landing areas include a plurality of special instruction landing areas, such as area 32 which require a player to follow special steps.

The game board 10 further includes a central starting/finishing area 36, as well as special indica in each destination area, such as indicia 38 in area 36 and indicia 40 in destination area $30^1$. The indicia 38 indicates a special program or category to be followed by a player destined for this area, as will be more fully apparent from the ensuing discussion. Other decorative indicia can be included in the various areas of the game board, as indicated for indicia 42 in area 22'.

The central area indicia 38 signifies earth, and the other destination areas signify as follows: $30^1$=technical information; $30^2$=television series; $30^3$=star fleet regulations; $30^4$=movies; $30^5$=star fleet personnel; and $30^6$=aliens. According to the category selected by a player, he will move in the area associated with a particular destination, as will be apparent from the ensuing discussion.

Figure 2:
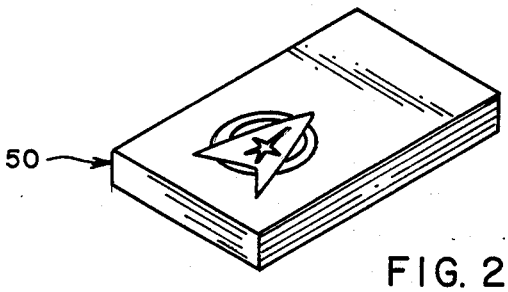
FIG. 2 is a perspective of a rules and information book used in the game embodying the present invention.

The game also includes a rules/information book 50 as shown in FIG. 2. The book 50 contains general information regarding each of the above-mentioned catagories as well as game rules, and other information, such as questions and answers, necessary to play the game.

Figure 3:
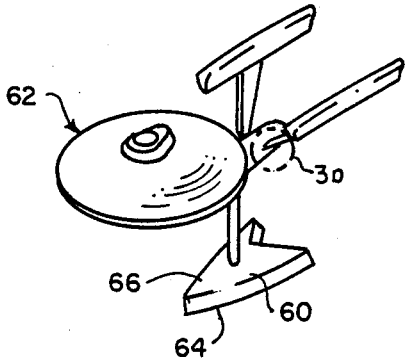
FIG. 3 is a perspective of a model that is to be assembled during the playing of the game.
Figure 3D:
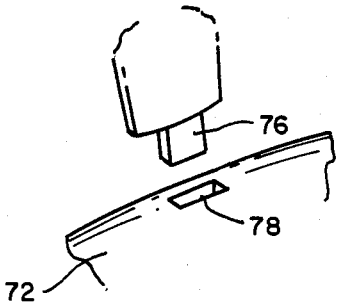

The game is played with game pieces, such as the game piece 60 shown in FIG. 3. The game pieces double as player markers and as support bases for a model 62 which simulates the spaceship, ENTERPRISE used in the adventures of STAR TREK. Each player has his own marker, and each marker can be different; however, each marker has a wide base 64 adapted to be placed in the various areas on the game board, and a bore through top surface 66 of the marker.

Figure 4:
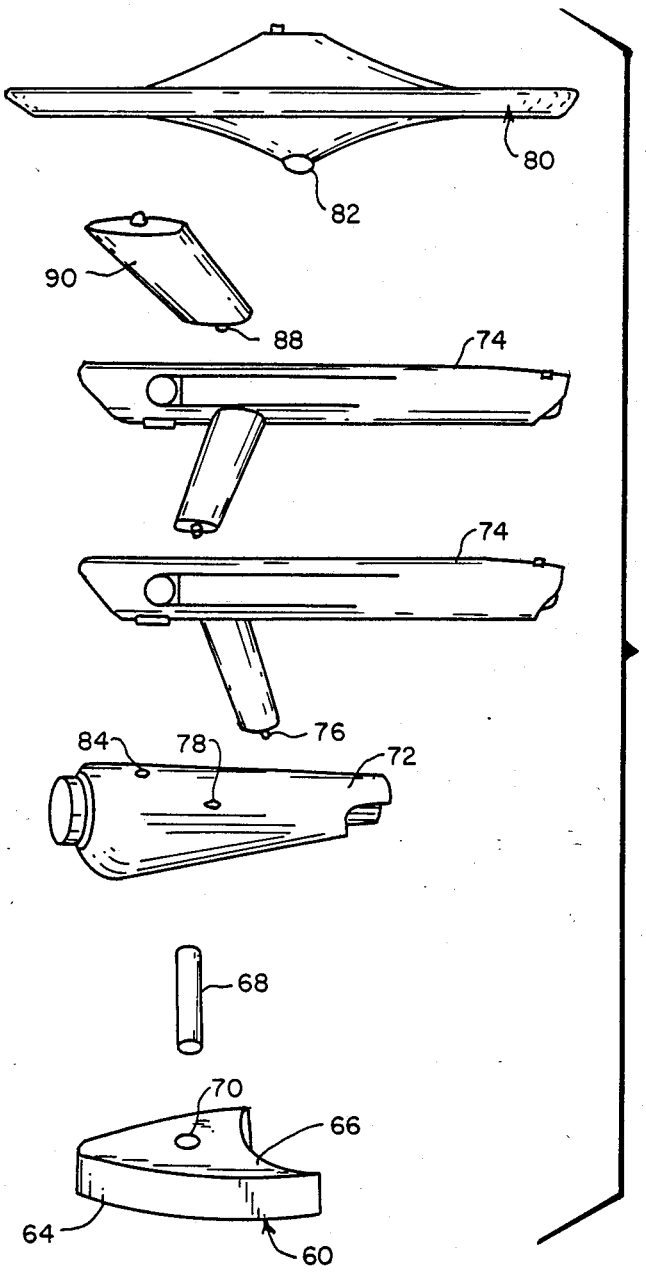
FIG. 4 is an exploded blowup of one portion of the model shown in FIG. 3, with FIG. 4*a* showing an assembled model.
Figure 4A:
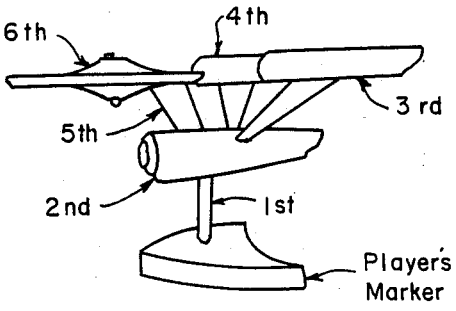

Referring to FIGS. 3 and 4, it seen that the model is composed of a plurality of separable and assembleable parts, such as support rod 68 that is sized and adapted to fit snugly into the bore 70 in the marker; a fuselage 72 of the ENTERPRISE having a bore which is adapted to snugly receive the support rod 68; engine simulating wings 74 having pegs, such as peg 76 adapted to fit snugly into corresponding bores, such as bore 78 on the fuselage to mount the engine simulating wings to the fuselage; main ship portion 80 having pegs, such as peg 82 adapted to snugly fit into bores, such as bore 84 on the fuselage to attach the main ship portion 80 to the fuselage, and bore 86 adapted snugly receive a peg 88 of a ship section 90. The ship section 90 can be located either on top of the main ship portion or on the bottom thereof, and can have a peg 89 which can be received in a bore 91 on piece 80. A complete model is shown in FIG. 4*a*.

It is further noted that the playing rules can include a provision that anytime a player loses a ship piece, that player must mark on a category checklist which category is forefeited. That category must then be answered correctly in order to regain a ship piece. However, the rules can provide that each ship piece need not belong to a specific category. The rules can provide that the ship be put together in a specific order as noted in FIG. 4*a*, and that ship pieces are to be awarded by answering main category questions correctly and are awarded in a specific order (e.g., the order noted in FIG. 4*a*). The rules can provide that ship pieces are lost in a specific order.

As will be discussed below, the object of the game is to assemble the model and advance to a special area of the game board, and the first player accomplishing this object will be the winner of the game.

Player movement is controlled by dice (not shown) and playing cards, such as shown in FIGS. 5, 6, 7 and 8. The playing cards will be described in conjunction with the description of the game procedure.

GAME PROCEDURE

STARTING THE GAME: Each player in turn rolls the die such as die D shown in FIG. 9. The player with the lowest number begins the game. Once the beginning player is determined, play continues clockwise from the beginning player.

HOW TO PLAY: Each player chooses a marker or game piece 60 and the beginning player then rolls the die. Beginning from the center of the board, area 36, the player then proceeds to the category of his choice, with the categories being noted above as $30^1$ to $30^6$. An opposing player asks a question from a question card 90 shown in FIG. 5 as having a front face 92 that is divided into questions from each category, such as question 93 from category $30^1$, question 94 from category $30^2$, question 95 from category $30^3$, question 96 from category $30^4$, question 97 from category $30^5$ and question 98 from category $30^6$, with corresponding answers 93A–98A on the rear 100 of the card 92 also shown in FIG. 5.

If the player answers the question correctly, he continues to roll the dice and advance the number of playing areas corresponding to the number on the dice every time he answers a question correctly. An incorrect answer does not permit the player to advance, and he loses his right to continue to throw the dice and advance toward his chosen destination. Player turns continue clockwise.

The player continues along path 26 until he reaches his destination area. Upon reaching that destination area, the player must answer a question from that category, as propounded from the book 50 by an opponent. If this question is answered correctly, the player wins a playing piece of the model 62 associated with that destination area. For example, a player landing on destination area $30^2$, upon answering the question associated with that area about some trivia from the television series STAR TREK, obtains, for example, the support rod 68 for the model.

Upon receiving the element of the model, the player checks off the category he has completed on card 102, shown in FIG. 6. Thus, as the player completes categories, he continues to receive parts of the model 62 and checks off the parts on the game card 102 so as to complete categories associated with the destination area $30^1$ through and including area $30^6$ as indicated in FIG. 6.

Selected ones of the game piece landing area 28 have special instructions thereon which require the player landing on such selected landing area to answer special questions or to perform special game steps. For example, landing area 28RA indicates an alert condition in red space and requires the player landing thereon to answer a question 104 from a Kobayashi Maru Card 106 as shown in FIG. 7. FIG. 7 shows the front of such card and the question associated with the card can appear in book 50 or on the back of the card. The answer can be in the book or on either side of the card. If the player answers such question correctly, he continues to roll the dice and advance towards his destination area. However, if he answers the question 104 incorrectly, he must draw an Alert Condition Red penalty card 108 shown in FIG. 8 and abide by penalty 110 appearing thereon. Once used, the cards are returned to a deck. The special areas can be located at a variety of locations on the board 10. It is noted that the penalty 110 can include the loss of a model piece, and if such occurs, the player can be given the option of which piece to forfeit. The model piece so forfeited is checked off from the list on card 102 accordingly. It is also noted that the penalty can include total ship destruction, in which case, the player must begin again from the central area 36.

The game object can include the requirement that a player construct his ship and then return to the central area 36 via the same process as above described in which a dice is rolled, the game piece is advanced according to the number on the dice, questions asked and answered and the like. Upon return to the central area, the game rules can include a special category of questions that must be answered before a player returning to such central area will be declared the winner. Such special questions can be included in the book 50, or on special cards. The rules can also include a special provision in which the player is forced to leave the central area, such as if he answers the special questions incorrectly.

The playing rules can also include a provision in which the players must obtain the model parts in a specified order.

The rules can also include special penalties as exemplified by the penalty 110 discussed above. These penalties can include, but are not limited to the following: ship destruction; loss of engines (which could cause forfeiture of a player's next turn, or turns); return to central area 36 or the movement to another playing area; the requirement that a player forfeit turns until he rolls a specified number on the dice; loss of one or more model pieces; return to the central area and loss of one or more turns; movement only in specified directions; loss/gain of turns depending on the number rolled on the dice; and the like.

It is also noted that the rules can provide that the player move in specified directions from each destination area to the next, or permit the player to choose his own path. The rules can also provide a specified number of moves which are permitted for each player, after which he is eliminated from the game or forfeits turns or other such penalty. The rules can also provide a time limit for answering any specified question, or the total number of incorrect answers permitted any player, or other such variation as will occur to those skilled in the board game art based on the disclosure presented hereinabove.

It is to be understood that while certain forms of the present invention have been illustrated and described herein, it is not to be limited to the specific forms or arrangement of parts described and shown.

We claim:

1. A method of playing a game comprising:

(A) providing a game which comprises (1) a hexagonal game board which includes (i) a plurality of areas divided by game piece landing areas with special landing areas having special instructions, and destination areas which include areas associated with various aspects of STAR TREK adventures, said various aspects including aspects associated with the television series, star fleet regulations, STAR TREK movies, aliens associated with STAR TREK, fleet personnel, technical information associated with STAR TREK, and (ii) a central area, (2) a plurality of instruction cards associated with the special landing areas priding special instructions for the continuation of play, (3) a plurality of question and answer cards having trivia questions thereon which must be answered by a player taking a turn for that player to continue play on any one turn, said trivia questions being based on adventures of STAR TREK, (4) a plurality of special question and answer cards having special questions thereon that must be answered before a player landing on a special landing area is permitted to obtain special positions on the game board;

(5) dice for controlling the number of landing areas which can be advanced for a turn, (6) a knockdown model having a plurality of part, with each part being obtained by the player taking a turn when that player achieves a certain goal, said model simulating ENTERPRISE used in STAR TREK and including a game piece that doubles a base of the model, a fuselage, engine portions, aa main ship portion and a support rod, (7) a game book containing rules and further criteria for play;

(B) rolling said dice to determine a starting player;

(C) having said starting player select a destination area toward which he wishes to advance;

(D) having said starting player roll the dice to determine how many landing areas to advance towards said destination area, and having said starting player advance a number of landing areas associated with a number appearing on said dice;

(E) having one opponent ask said starting player a trivia question based on STAR TREK;

(F) requiring said starting player to answer said trivia question;

(G) permitting said starting player to continue and to roll the dice again if the answer is correct, and causing said starting player to cease his turn if said answer is incorrect;

(H) having an opponent ask the player taking a turn a further question when that player taking a turn lands on a selected destination area;

(I) awarding the player taking a turn a model portion of said model when that player taking a turn answers said special question correctly, and causing said player taking a turn to cease his turn when the special question is answered incorrectly;

(J) having special questions asked of any player taking a turn who lands on specially selected landing and destination areas, and determining continued play of such player landing on said selected areas depending on the answer given to such selected questions, said continued play including steps of having an opponent ask a special question from a special list and requiring said player to draw a penalty card if the answer to the special question is incorrect and to follow instructions on said penalty card and permitting said player to continue play if the answer is correct, (K) providing a category card check list for each player with each category card including a special area for each of a plurality of categories;

(L) checking off an appropriate special area upon receiving a model portion;

(M) obtaining model parts according to a specified order;

(O) requiring special actions from any player landing on a predetermined landing area;

(P) determining a winner when one player accumulates all of the parts of said model and advances to a predetermined winning landing area;

(Q) requiring any player to correctly answer a question from a special list of questions before advancing to said predetermined winning landing area;

(R) requiring any player taking a turn to return to start upon landing on a selected penalty landing area;

(S) requiring any player taking a turn to lose a turn upon landing on a selected loss of turn landing area;

(T) placing a time limit on the answering of a question; and (U) selecting questions to be asked of a player taking a turn according to the destination area selected by such player taking a turn.

* * * * *